US005352509A

United States Patent [19]

Talling

[11] Patent Number: 5,352,509

[45] Date of Patent: Oct. 4, 1994

[54] INSULATING PRODUCT OF MINERAL FIBRE WOOL, INTENDED IN PARTICULAR FOR HEAT INSULATION OF PIPES AND METHOD FOR PREPARING THIS PRODUCT

[75] Inventor: Bob L. O. Talling, Abo, Finland

[73] Assignee: Oy Partek AB, Pargas, Finland

[21] Appl. No.: 179,762

[22] Filed: Jan. 10, 1994

Related U.S. Application Data

[63] Continuation of Ser. No. 768,313, Jan. 6, 1992, abandoned.

[30] Foreign Application Priority Data

Apr. 6, 1989 [FI] Finland ..... 89.1659

[51] Int. Cl.[5] ..... D04H 1/58

[52] U.S. Cl. ..... 428/288; 428/289; 428/311.5; 106/624

[58] Field of Search ..... 428/288, 289, 311.5; 106/624

[56] References Cited

U.S. PATENT DOCUMENTS

| | | | |
|---|---|---|---|
| 3,002,857 | 10/1961 | Stalego | 427/126 |
| 4,018,616 | 4/1977 | Sugahara et al. | 106/629 |
| 4,427,356 | 1/1984 | Kratel et al. | 428/195 |
| 4,985,163 | 1/1991 | Kratel et al. | 252/62 |

FOREIGN PATENT DOCUMENTS

| | | | |
|---|---|---|---|
| 2804069A1 | 8/1979 | Fed. Rep. of Germany | D04H 1/60 |
| 7513183-9 | 2/1981 | Sweden | B32B 19/04 |
| 7514229-9 | 10/1981 | Sweden | C04B 43/02 |

OTHER PUBLICATIONS

Derwent's Abstract No. 38 399 B/20, SU 614 061, publ. week 7920 (Dnepr Eng Cons Inst).

*Primary Examiner*—George F. Lesmes
*Assistant Examiner*—Christopher W. Raimund
*Attorney, Agent, or Firm*—Dressler, Goldsmith, Shore & Milnamow, Ltd.

[57] ABSTRACT

The invention relates to a heat insulation product of mineral fiber wool. The curable binding agent of the product is an aqueous suspension containing water glass and slag. The slag reacts hydraulically with the alkalis or the water glass yielding water resistant bonds. During the preparation of the product, the suspension of water glass and slag is agitated before being applied onto the product. The curing of tile binding agent can be carried out immediately or at a later time. Curing may be effected at room temperature or at an elevated temperature.

8 Claims, 4 Drawing Sheets

INSULATING PRODUCT OF MINERAL FIBRE WOOL, INTENDED IN PARTICULAR FOR HEAT INSULATION OF PIPES AND METHOD FOR PREPARING THIS PRODUCT

This application is a continuation of application Ser. No. 768,313, filed Jan. 6, 1992, now abandoned.

The present invention relates to an insulating product of mineral fibres intended in particular for the heat insulation of pipes. The product shall have a good temperature resistance, moisture resistance and a strength that resists a high temporary load, e.g. the steps of the pipe fitter on the pipe during installation operations. The insulating product shall be shapeable at once or later to the desired shape and subsequently curable at the prevailing outer temperature or at a raised temperature.

In view of an economically optimal production of the product, the production shall be feasible in a conventional installation for the production of mineral wool webs. The curing temperature shall be adaptabe to the circumstances and the curing time shall be short.

The Finnish patent specification 67751 discloses the production of insulating bodies based on mineral wool. In order to achieve the desired compression resistance and temperature resistance, clay sludge, preferably bentonite, is absorbed by means of under-pressure into a preshaped and cured tubular bowl or insulating plate. The process requires a curing of several hours in a furnace. The insulating body has a good temperature resistance, of at least 800° C., but is expensive owing to a slow and costly production process and expensive raw material. An additional drawback of the bentonite body is its coarse surface, requiring an additional surface treatment, i.e. milling, thus increasing the price of the material.

Phenol cured insulating bodies are also known. Phenol is a fairly cheap and rapidly curing binder. A phenol cured product resists temperatures of up to 250° C., but if the temperature is above 250° C. for a long period of time, the bonds are destroyed. At higher temperatures, of 400° C. and more, the binder residues flare up, the temperature rises rapidly and the product collapses. Another drawback of phenol insulating bodies consists in their emitting poisonous gases during burning.

The SE lay-out print 420 488, for instance, discloses the use of a mass based on water glass and clay mineral substances as a binding agent. The binder provides a good water and heat resistance in the product. On the other hand, the product has a poor compression resistance, meaning that e.g. a tubular bowl made of mineral fibres and treated according to the layout print does not resist temporary load. Moreover, the product is brittle and thus causes dusting.

According to the present invention, it has been noted that an insulating product can be achieved, which is especially suitable as a tubular bowl, out of a mineral fibre web prepared in a conventional manner by using as a binding agent a water glass based binder with an addition of slag.

Figure 1:
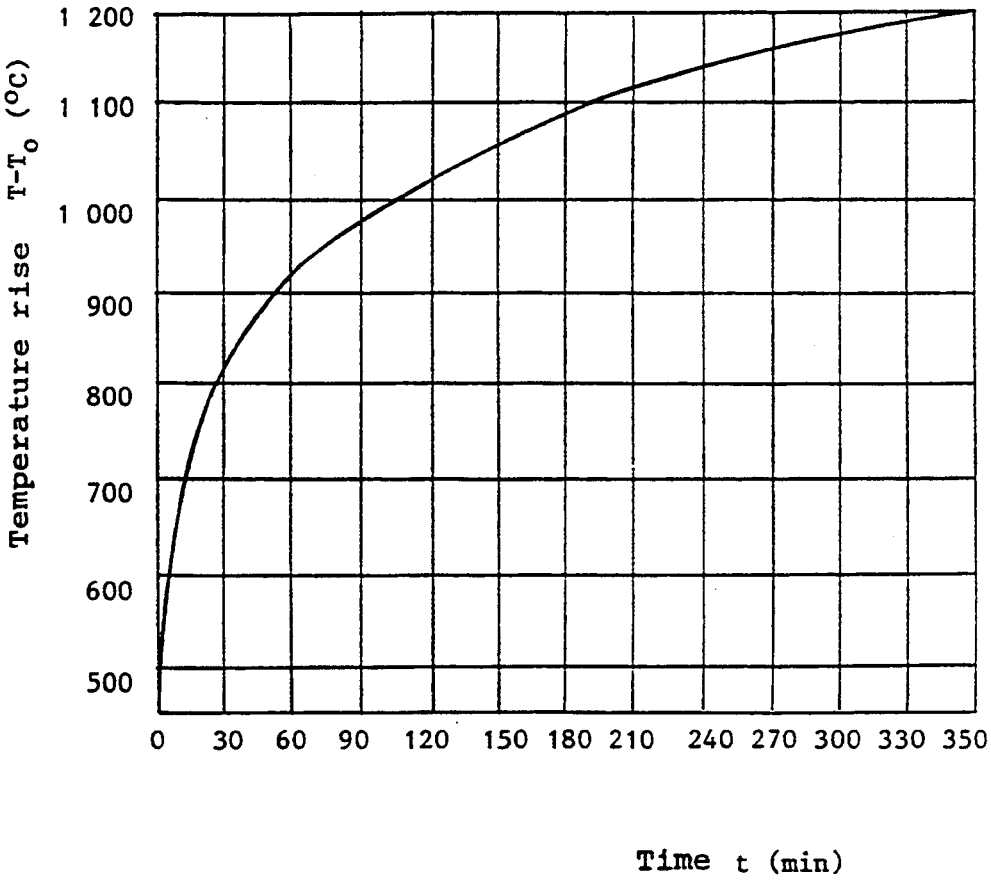
FIG. 1 shows the temperature rise on the fire side of a sheet product according to the present invention tested according to SFS 4193.

The slag imparts many valuable properties to the insulating material. The alkalis of the water glass act as activators of the slag (cf. slag alkali cement). Together with water glass, slag forms a hydraulic bond giving the cured product an improved compression resistance, a reduced brittleness and thus reduced dusting and grater dust particles, compared to products treated with binders containing water glass without a slag addition.

Moreover, a good temperature resistance is achieved in a product containing a binder based on water glass and having a slag addition. Due to the hydraulic bond of the slag to the water glass, the water is firmly bound, chemically bound to the structure. The chemically bound water increases the fire-resistance capacity of the material in that the water evaporating at a fire temperature keeps down the temperature for a longer period. A water glass based binder resists a longlasting temperature charge of up to 800° C.

Combined with the water glass, the slag increases the crystallinity of the material, thus reducing the moisture absorption tendency and the moisture sensitivity.

Moreover, a more rapid curing and the possibility of optional curing conditions are provided. The curing time for a product containing water glass and slag in the binder and by using conventional curing in a curing chamber is approx. 20–60 seconds for thin products and approx. 20 min. at the most for thick tubular bowls. Equally good curing times are achieved with phenol containing binders, but these binders are unsuitable in other respects. Other known binders require curing times of up to several hours.

Another advantage of the system water glass/slag is that the binder enables the forming of no-swelling compounds, although the temperature exceeds the swelling temperature of pure water glass, 160° C.

Further advantages of the slag is its reactivity at a normal temperature. This means among others that the slag totally prevents carbonation, which is a noticeable advantage. Other mineral curing agents, like fly ash and clay, do not possess this property. Clay and corresponding substances mainly act as fillers.

It has been noted according to the invention, that the advantageous effects of slag are achieved with relatively small amounts of slag, both with regard to the amount of water glass and to the amount of fibres. In the binder, the weight ratio of the dry substance of the water glass to the slag can be approx. 100:1–100:50, prefrably 10:1–10:2. In the product, the weight ratio of the mineral fibre amount to the dry substance of the water glass can be approx. 100:1–100:20, preferably 100:5–100:15.

The slag of the binder is preferably blast furnace slag.

The slag/water glass system is well controllable and thus provides a geat flexiblity for the method of preparing an insulating product of mineral wool. Controllable components are among others:

| slag | water glass (VG) | curing conditions |
|---|---|---|
| slag chemistry | type of VG | temperature |
| slag mineralogy | molar ratio | time |
| grinding fineness | modifier | environment (moisture) |
| particle distribution | VG compositions | |
| modifier | | |
| slag amount | | |

Knowledge of the behaviour of various slags in an alkaline environment enables the control of the properties of the final product.

The slag reacts with the alkalis of the water glass, i.e. it is activated. Thus, water resistant hydrate phases of a zeolite type are obtained. Owing to this mechanism, the molar ratio $R_s$ (the ratio of the silicon moles to the alkali moles in the water glass) for the residual unreacted water glass rises so much that also this residue becomes water resistant. A higher alkali content, i.e. a lower molar ratio $R_s$, requires a higher slag portion in order to tie up the alkalis in a water resistant form.

The molar ratio $R_s$ of commercial water glass is approx. 3.3. According to the invention, it has been observed that very low molar ratios are also usable, requiring in that case high slag contents in order to provide water resistance of the final composite. Even NaOH or $Na_2CO_3$ are usabe. However, it is preferable to use the molar ratio $R_s \geqq 2.3$. The optimal moisture resistance with regard to the reactivity with slag is obtained for $R_s = 2.7-3.0$.

The main components of the slag-glass are CaO, MgO, $SiO_2$, $Al_2O_3$. It is generally true about slag/water glass systems that the lower the CaO content, i.e. the ratio $CaO/SiO_2$, the lower a molar ratio $R_s$ should be used in order to obtain a hydraulic bond within a reasonable period of time. When using low molar ratios, $R_s \leqq 2.7$, the slag content has to be increased. With a higher ratio $CaO/SiO_2 \geqq 1.3$, water glass can be used with $R_s \geqq 3.3$ , still obtaining a sufficient reactivity.

The reaction degree is controlled by means of the temperature and the curing time. A higher curing temperature shortens the curing time and vice versa.

A lower $R_s$ shortens the curing time at a constant temperature. A higher $R_s$ requires a longer curing time or a higher temperature.

By prereacting slag with water glass at a normal or a raised temperature under agitation, the reaction degree and the curing rate can be further increased. A finished hydrate phase is consequently created, speeding up the curing when the binder has been applied onto the mineral wool.

In case the curing temperature exceeds approx. 160° C., the slag content has to be increased in order to prevent the water glass from swelling (cf. slag alkali cement).

Trituration of the slag increases the reaction rate and the reactivity. This enables to use a water glass with a higher $R_s$, or optionally a very rapid curing can be ahieved at a lower $R_s$. A finely ground slag also improves the stability of the slurry of water glass and slag.

The water glass can be a sodium, potassium, lithium or ammonium silicate solution. In case the slag content is high, hydroxides and/or carbonates can be added.

The preparation of a mineral wool product and the addition of the binder based on water glass and containing slag takes place conventionally in a conventional set of apparatus. The binder is added as a solution through a nozzle to the fibres in the wool chamber of a conventional machine line. The water glass and the slag are premixed in water and are kept in agitation before the distribution on the wool. The curing of the binder mixed wool material takes place at once or later, at room temperature or at a raised temperature.

Besides water glass and slag, the binder solution can contain possible additional curing, modifying, dust binding and/or hydrophobing agents.

The spraying of the binder solution and the additives takes place directly after the fibre formation, preferably in the wool chamber. This is an essential advantage, since the wool is in a virginal state here and thus has a good adhesiveness.

The binder composition is sprayed on the wool through the binder nozzles of the centrifuge, both peripheral and central sprayers being then usable. Optionally two different solutions can be fed into the wool, so that possible modifying and/or additional curing agents are fed through the one sprayer and a slurry of water glass/slag+possible modifying agents through the other sprayer.

An additional binder solution can appropriately be added to the wool in a subsequent step of the production of the insulating material. By applying more binder solution on the primary web, a composite having a better resistance is achieved. By adding additional additives on the primary web special properties can be given to the material.

Before the feeding of the binder only compatible substances need to be premixed, whereas the other necessary additional components are mixed only at the moment of application. The mixing can be carried out for istance by rapid mixing, e.g. in tubular mixers. Thus the dwell time will be short enough not to allow any gelling or precipitating reactions to take place. The required additional water is also adjusted by feeding into the rapid mixer. The water amount is adjusted so as to provide the correct moisture for the primary web and prevent dusting. The water evaporation taking place in the wool chamber increases the viscosity of the fibre composition applied onto the fibre. The high viscosity means a very low ion migration, thus decreasing the reaction rate. In this manner, the primary web retains its elasticity and curability for several days/weeks, provided that further water discharge is prevented.

When producing insulating sheets, these are appropriately cut out from a mineral web, which has been conventionally laid out by oscillating to the desired thickness and then cured.

According to a preferred method, the mineral fibre web is cured at room temperature, for instance between metal sheets. Thus the sheet will acquire a better flexibility. A slowly cured fibre body is, as is known, more flexible, elastic, than a fibre body that has to be cured at a high temperature.

According to another preferred embodiment a secondary web having the desired thickness is taken up in an uncured state and stored in a non curing environment, e.g. enclosed in plastic at a suitable temperature and during a determined time at the most. This insulating material is used in situ for the insulation in places that are not easily accessable and have an awkward shape, such as for instance renovation objects. Afterwards, the insulation cures at the prevailing temperature. It is relatively easy to apply an insulating mat having a suitable thickness onto or around various bodies difficult to access. The curing does not require any special measures or equipment since it takes place spontaneously at the prevailing temperature.

The method is also suitable for blow wool applications, in which uncured fibre material torn into small tufts is applied onto pipes, where the wool can be cured at the prevailing temperature.

When producing tubular bowls, a secondary web is shaped to the desired shape of a tubular bowl, and is subsequently cured in a known manner. The curing can take place rapdily at a high temperature or slower at a lower temperature.

Additional additives, like additional curing, modifying, dust binding and hydrophobizing agents cooperate with the water glass/slag system.

According to the invention, the additional curing agents consist of mineral salts and compounds, suitable acids, esters or alcohols or of combinations of these. The mineral salts can be e.g. magnesium, aluminium or calcium salts or compounds. Phosphoric acid, for instance, is a usable acid. Buffer curing agents can also be used for adjusting the storage time. The additional curing agent may be a combination of the above mentioned curing agents.

For the water glass, various modifying agents like organic and unorganic polymers, cellulose and silicones like silicon organic polymers are appropriately used. Also monomers polymerized by e.g. a pH change or a temperature rise during the curing can be used. The modifying agents of water glass have in common the fact of not being film forming. By means of the modifying agents one aims at softening the water glass, thus increasing its adhesiveness to the fibre surface.

The water glass modifier improves the elastic properties, the water resistance, carbonation resistance etc. of the water glass.

As dust binding agents, alcohols, polyols, film forming polymers, gelling polymers, waxes, oils, fats, paraffines etc. are appropriately used. The task of the dust binding agent is to bind together the dust or to bind it to the main matrice either physically (film forming) or chemically (surface active properties). In case high temperature curing is used, melting dust binding agents, e.g. stearates, can be used, or curing dust binders, forming a film over the matrice. A great number of the dust binding agents simultaneously have a water repellent effect.

The task of the hydrophobizing agent is to prevent water and moisture from penetrating into the product. As hydrophobizing agents, silanes, silicones, oils, various hydrophobic compounds and hydrophobic starch are used. It is essential that possible hydrophilic emulgators are destroyable, which happens by raising the pH value or by a temperature raise.

The polybutene silane compound has proved especially advantageous as a dust binding agent and a hydrophobing agent. The polybutene acts as a dust binder and the silane as a hydrophobing agent.

Within the various groups, compatible compounds can be mixed in advance, whereas non compatible compounds have to be mixed immediately before the application or applied through separate nozzles.

The invention is explained below by means of various examples and indicating the values of various essential properties of the produced insulating products.

Example 1

A suspension of 83% of water glass ($R_s$=2.7, dry content 39%) and 13% of blast furnace slag were mixed with a modifying solution (dry content 8%), containing silane as a hydrophobing agent and polybutene as a film forming dust binder, in a tubular mixer. Calculated as dry substance, the water glass forms 11.2% of the wool, the slag 13% of the water glass and the modifiers 1.8% of the water glass. The wool production was 2.8 tons/h and the dosing of the various solutions was 10.2 l/min or water glass-slag-suspension, 3.2 l/min of modyfier solution as well as water 10 l/min. The primary web was rolled into a tubular bowl having a diametre of 350 mm and a wall thickness of 60 mm and the tubular bowl was cured at 145° C. for 3 min. A piece 63.5 x 63.5 mm was cut out from the tubular bowl and was tested with regard to linear shrinking at 600° C. according to ASTM 356-60. The shrinking was only 1.4% when the density of the product was 101 kg/m$^3$.

Example 2

A suspension of 95% of water glass ($R_s$ =3.3, dry content 37%) and 5% of blast furnace slag were mixed with an additional curing agent (5% $H_3PO_4$) and a modifier solution (dry content 5%), containing a hydrophobizing agent and a film forming polymer as a dust binder, in a tubular mixer. Calculated as dry substance, the water glass forms 11.4% of the wool, the slag 5%, the phosphoric acid 2.5% and the modifiers 0.8% of the water glass. The wool production was 3.2 tons/h and the dosing of the various solutions was 12.5 l/min of the water glass/slag-suspension, 5.3 l/min of the additional curer, 4.2 l/min of the modifier solution as well as water 11 l/min. Out of the primary web, a sheet web was prepared in a curing chamber at 140° C. Fire tests according to SFS 4193 were carried out on sheets having a thickness of only 26 mm and a density of 217 and 225 kg/m$_3$ respectively, yielding a fire resistance of 52 and 58 min. respectively. The temperature rise on the fire side according to SFS 4193 appears from FIG. 1 and table 1. The test was continued for one hour and the temperature was 925° C. at the end of the test. The sheet was totally undeformed and unbent and the burnt area still had a high residual strength.

It should be observed that the results given in the figures do not by any means indicate the upper limits, but only typical values that can be obtained. The results are collected from 11 different full-scale runs testing more than 70 different formulas.

Figure 2:
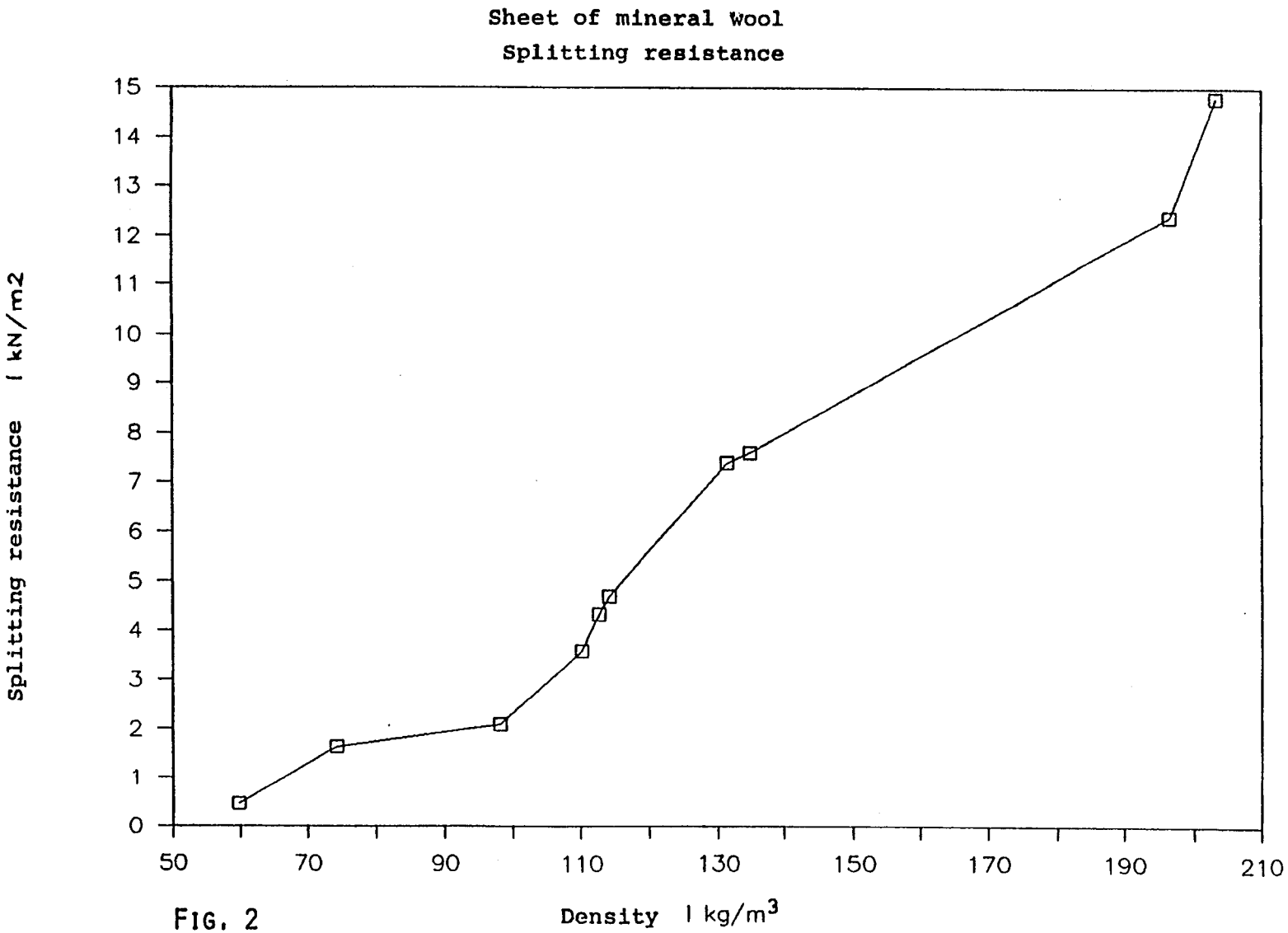
FIG. 2 shows a typical relation between the splitting resistance and the density of a sheet product according to the present invention.

FIG. 2 shows a typical relation between the splitting resistance and the density of a sheet product according to the invention.

Figure 3:
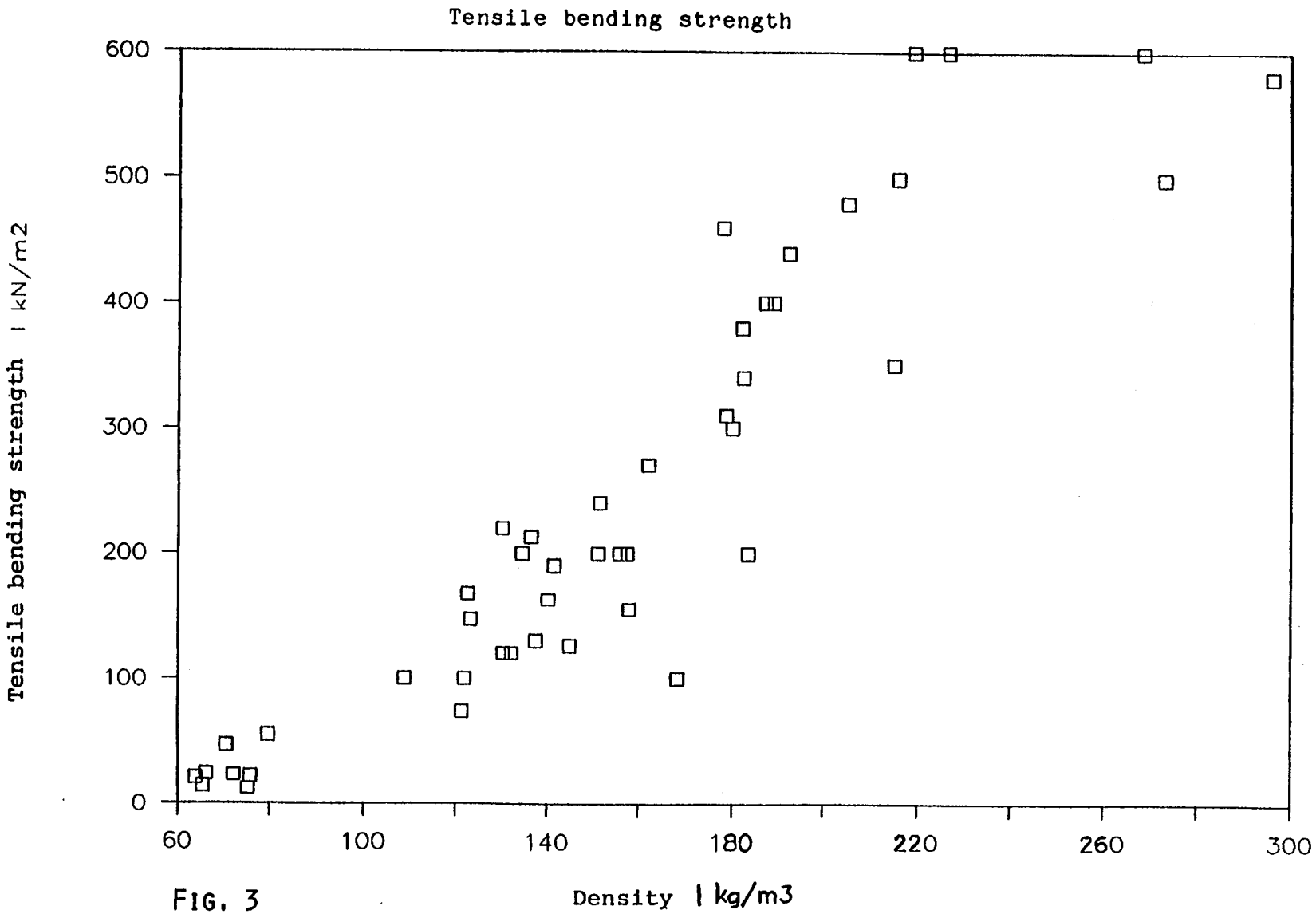
FIG. 3 shows the relation between the tensile bending strength and the density of a number of sheet products according to the present invention.

FIG. 3 shows the relation between the tensile bending strength and the density of a number of sheet products according to the invention.

Figure 4:
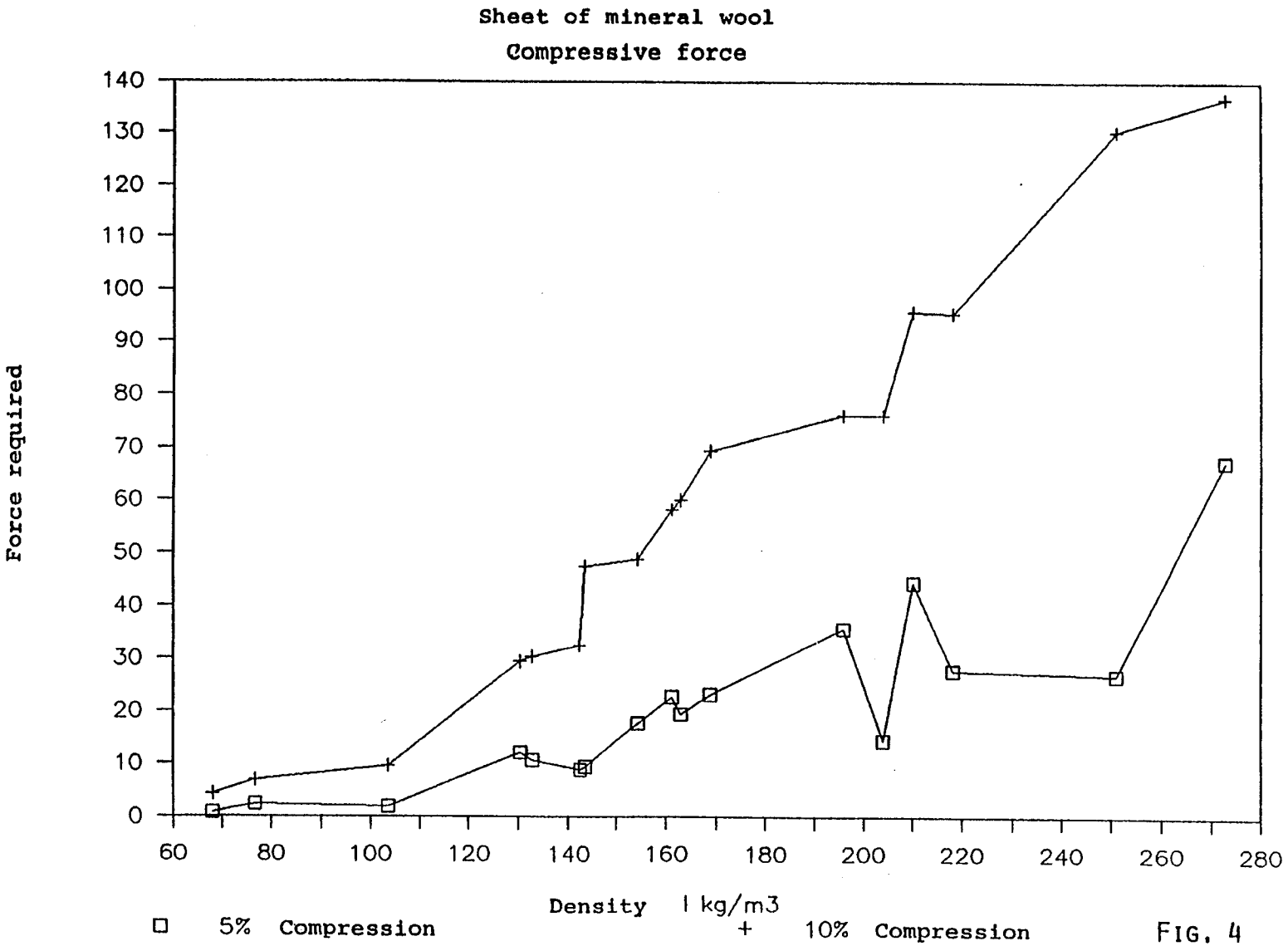
FIG. 4 shows the force required for compressing a cured sheet product according to the invention 5 and 10% respectively.

The force required for compressing a cured sheet product according to the invention 5 and 10% respectively is indicated in FIG. 4. The force is given as kN/m$^2$ as a function of the density.

Water absorption was tested according to BS2972:1975. The water absorption of sheet products aiming at a good hydrophobicity was:

| |
|---|
| After an immersion of 0.5 hours, only 0.3–1.6% by volume |
| After an immersion of 1 hour, only 0.6–2.4% by volume |
| After an immersion of 2 hours, only 1.1–3.0% by volume |
| After an immersion of 1 day only 3.8–7.0% by volume |
| After an immersion of 7 days only 9.1% by volume |

The moisture resistance was tested in a climatic chamber by measuring the swelling during storage at 40° C. and 95% relative moisture. The temperature was selected as 40° C. in order to obtain accelerated results, since swelling at 20°-30 ° C. is practically none or very slow. The optimal results with a sheet product having a density of 140 kg/m$^3$ showed no swelling after 1 day and only a swelling of 0.3% after 7 days.

TABLE 1

| Temperature rise as a function of time | |
|---|---|
| Time t min | Temperature rise of the furnace T—T° °C. |
| 5 | 556 |
| 10 | 659 |
| 15 | 718 |
| 30 | 821 |
| 60 | 925 |
| 90 | 986 |
| 120 | 1029 |
| 180 | 1090 |
| 240 | 1133 |
| 360 | 1193 |

Example 3

A suspension of 82% water glass ($R_s$=2.4, dry matter content 44%) and 18% blast furnace slag were mixed with a modifier solution (dry content 10%), containing a hydrophobizing agent and a film forming polymer as a dust binding agent, in a tubular mixer. Calculated as a dry substance, the water glass represents 15.8% of the wool, the slag 50% of the water glass and the modifiers 3.6% of the water glass. The wool production was 2.8 tons/h and the dosing of the various solutions was 13.2 l/min of water glass/slag-suspension, 6.0 l/min of modifier solution and water 8 l/min. Out of the primary web, tubular bowls were prepared, having an outer diametre of 520 mm, a thickness of 120 mm and a density of 96.0 kg/m$^3$. The bowls were mounted on a steam pipe, whose temperature was raised up to 520° C. After 60 hours at this temperature the insulation was inspected and its λ value was determined. The λ value was: 0.1010 W/m ° C. at 520° C. The bowls resisted the temperature (520° C.) well. The only remarkable difference was that the inner surface of the bowl had become harder than the outer surface, probably due to the continued curing of the binder.

I claim:

1. Insulating product of mineral fibres intended in particular for the heat insulation of pipes whereas its binder consists essentially of water glass and slag, the water glass having a molar ration $R_s$ of 2.3 to 3.0, in which product the weight ratio of the mineral fibre amount to the dry substance of the water glass is 100:1-100:20, the slag is present in the binder in such an amount that the weight ratio of the dry substance of the water glass to the slag is 100:1-100:50, and the slag is pulverized blast furnace slag.

2. Insulating product according to claim 1, whereas the binder is present in the product in such an amount, that the weight ratio of the mineral fibre amount to he dry substance of water glass is 100:5-100:14.

3. Insulating product according to claims 1 or 2, whereas the slag is presenting the binder in such an amount that the weight ratio of the dry substance of the water glass to the slag is 10:1-10:2.

4. Insulating product according to claims 1 or 2, whereas the binder contains dust binding, hydrophobizing or additional curing agents for the mineral fibres.

5. Insulating product according to claims 1 or 2, whereas it is uncured and packed in a moisture- and gasproof package.

6. Insulating product according to claim 1 or 2, whereas the binder consists essentially of water glass and slag, the water glass having a molar ratio $R_s$ of 2.7-3.0.

7. Insulating product according to claims 1 or 2, whereas the binder contains dust binding, hydrophobizing and additional curing agents for the mineral fibres.

8. Insulating product according to claim 7, whereas the binding agent is polybutene and the hydrophobizing agent is silane.

* * * * *